US006641068B2

(12) United States Patent
Ostergaard

(10) Patent No.: US 6,641,068 B2
(45) Date of Patent: Nov. 4, 2003

(54) JAW FOR A JAW CRUSHER

(75) Inventor: David A. Ostergaard, Cedar Rapids, IA (US)

(73) Assignee: Cedarapids Inc., Cedar Rapids, IA (US)

( * ) Notice: Subject to any disclaimer, the term of this patent is extended or adjusted under 35 U.S.C. 154(b) by 0 days.

(21) Appl. No.: 09/944,467

(22) Filed: Aug. 31, 2001

(65) Prior Publication Data

US 2003/0042345 A1 Mar. 6, 2003

(51) Int. Cl.[7] ..... B02C 1/10
(52) U.S. Cl. ..... 241/268; 241/300
(58) Field of Search ..... 241/264, 265, 241/266, 267, 268, 269, 291, 300

(56) References Cited

U.S. PATENT DOCUMENTS

| | | | | |
|---|---|---|---|---|
| 2,065,784 A | * | 12/1936 | Zillgitt | 241/264 |
| 2,122,033 A | * | 6/1938 | Hallenbeck | 241/264 |
| 2,258,075 A | | 10/1941 | Symons | |
| 3,144,214 A | * | 8/1964 | Perdue | 241/264 |
| 3,687,062 A | * | 8/1972 | Frank | 241/264 |
| 3,946,955 A | * | 3/1976 | Bond | 241/264 |
| 3,984,058 A | | 10/1976 | Archer et al. | |
| 4,039,151 A | | 8/1977 | Coxhill et al. | |
| 5,046,670 A | | 9/1991 | Leikin et al. | |
| 5,110,057 A | | 5/1992 | Karra et al. | |
| 5,172,869 A | | 12/1992 | Kitsukawa et al. | |
| 5,482,218 A | | 1/1996 | Ha | |
| 5,630,555 A | | 5/1997 | Boyd | |
| 5,725,166 A | | 3/1998 | Nakayama et al. | |
| 5,772,135 A | | 6/1998 | Styles | |
| 5,799,888 A | | 9/1998 | Hamaguchi et al. | |
| 5,802,747 A | | 9/1998 | Nojima | |
| 5,857,630 A | | 1/1999 | Hamaguchi et al. | |
| 6,116,530 A | | 9/2000 | Altmayer et al. | |
| 6,126,101 A | * | 10/2000 | Ostergaard | 241/264 |

* cited by examiner

*Primary Examiner*—Maria Rosenbaum
(74) *Attorney, Agent, or Firm*—Marshall, Gerstein & Borun LLP

(57) ABSTRACT

A jaw crusher having one or more improved elliptical jaw members is disclosed. The jaw crusher includes a frame, a stationary jaw, and a moveable jaw. The stationary jaw is mounted to the frame and includes a top edge, a bottom edge, and an interconnecting face extending between the top edge and the bottom edge. The moveable jaw, which is shiftably mounted to the frame and is moveable toward and away from the stationary jaw, includes a top edge, a bottom edge, and an interconnecting face extending between the top edge and the bottom edge. The face of at least one of the stationary jaw and the moveable jaw includes an elliptical profile.

32 Claims, 10 Drawing Sheets

JAW FOR A JAW CRUSHER

FIELD OF THE INVENTION

The present invention relates to jaw crushers for crushing aggregate material and having a stationary crushing jaw and a moveable crushing jaw. More specifically, the present invention relates to an improved jaw face for use on the stationary jaw and/or the moveable jaw.

BACKGROUND OF THE INVENTION

A typical jaw crusher includes a stationary jaw and a moveable jaw that are spaced apart to define a crushing chamber in between. Aggregate material is fed into the crushing chamber and is crushed by cooperating surfaces on each of the jaws as the moveable jaw repeatedly reciprocates toward and away from the stationary jaw.

Typically, the crushing surface of one or both of the jaws will have vertically oriented teeth which run generally parallel to the flow of material through the crushing chamber. Each tooth on each of the jaws is aligned with a corresponding tooth space or valley on the other jaw, such that the material in the crushing chamber is crushed or broken as the material is compressed between the alternating teeth on the face of the jaws. This type of crushing is commonly referred to as cleavage or compression cleavage crushing.

Due to the tremendous forces experienced by the jaw faces, many jaws are manufactured of a heat treated, high manganese content steel casting. During the crushing process, and depending on the angle between the jaws when the jaws are in their closest position, commonly referred to as the nip angle, some portions of the jaw faces may wear much faster than other portions of the jaw faces. For example, for relatively large nip angles, material entering the crusher will quickly fall to the bottom of the crushing chamber, and the bottom portion of the jaw faces will tend to wear faster than the top portion of the jaw faces. Consequently, the faces of one or both of the jaws will be symmetrical, such that the jaws can be removed, turned over, and reinstalled in order to prolong the life of the jaws.

If the nip angle is too large, the material is not gripped by the jaws, and the jaws may actually spit the material out of the contact zone or, in extreme cases, completely out of the crusher. Most crushers will have a maximum nip angle which cannot be exceed in order to avoid material rejection. The maximum nip angle may change depending on the type and shape of various materials. For example, hard, generally spherical alluvial rock will typically dictate a lower maximum nip angle. Further, the angle between the jaw teeth must be kept to a minimum in order to avoid wedging of material between the teeth.

Depending on the desired nip angle between the jaws, which as outlined above may depend on a variety of factors including the type and shape of the material to be crushed, the lower portion of the jaw face may wear significantly faster than the middle portion and the upper portion. Although the jaws can be turned over as mentioned above, other approaches exist which are designed to even out the wear patterns thereby extending the life of the jaws. The most commonly employed approach is to make the profile of the jaw face in the form of a circular arc. Such jaws are commonly referred to as "bellied" jaws. On such jaws, the teeth protrude outwardly at the center of the jaw face, following the profile of an arc having a large radius. This approach reduces the size of the crushing chamber and causes smaller material to be crushed toward the top of the crushing chamber, thus altering the wear patterns.

However, this approach also lowers the nip angle in the lower portion of the crushing chamber, while increasing the nip angle in the upper portion of the crushing chamber. The increased nip angle at the upper portion of the crushing chamber causes problems when crushing larger material sizes, such as the harder generally spherical materials mentioned above.

Accordingly, there exists a continuing need for improvements in the design of jaws for use in jaw crushers.

DETAILED DESCRIPTION OF THE PREFERRED EMBODIMENT

The embodiments described herein is not intended to be exhaustive or to limit the scope of the invention to the precise form or forms disclosed. The following embodiments have been chosen and described in order to best explain the principles of the invention and to enable others skilled in the art to follow its teachings.

Figure 2:
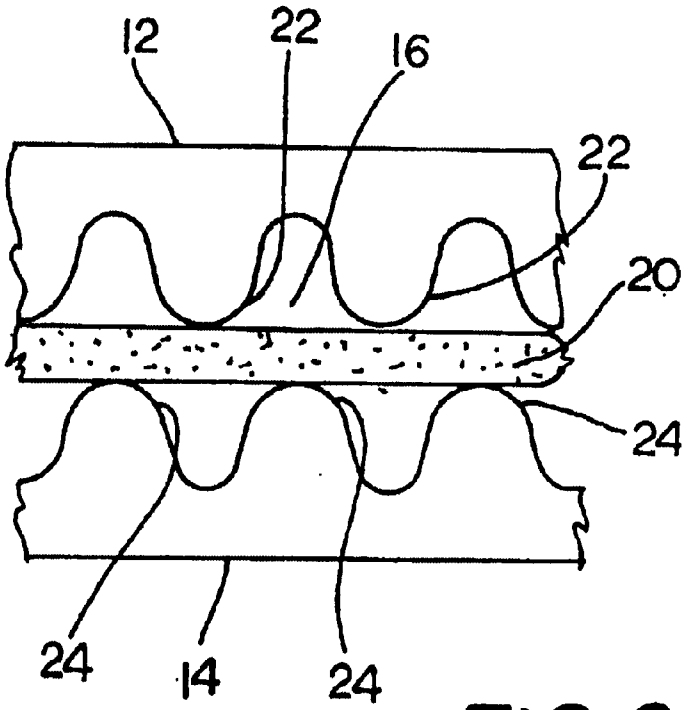
FIG. 2 PRIOR ART
FIG. 2 is an enlarged fragmentary view taken along line 2—2 of FIG. 1 and illustrating a conventional tooth arrangement on each of the jaws.
Figure 1:
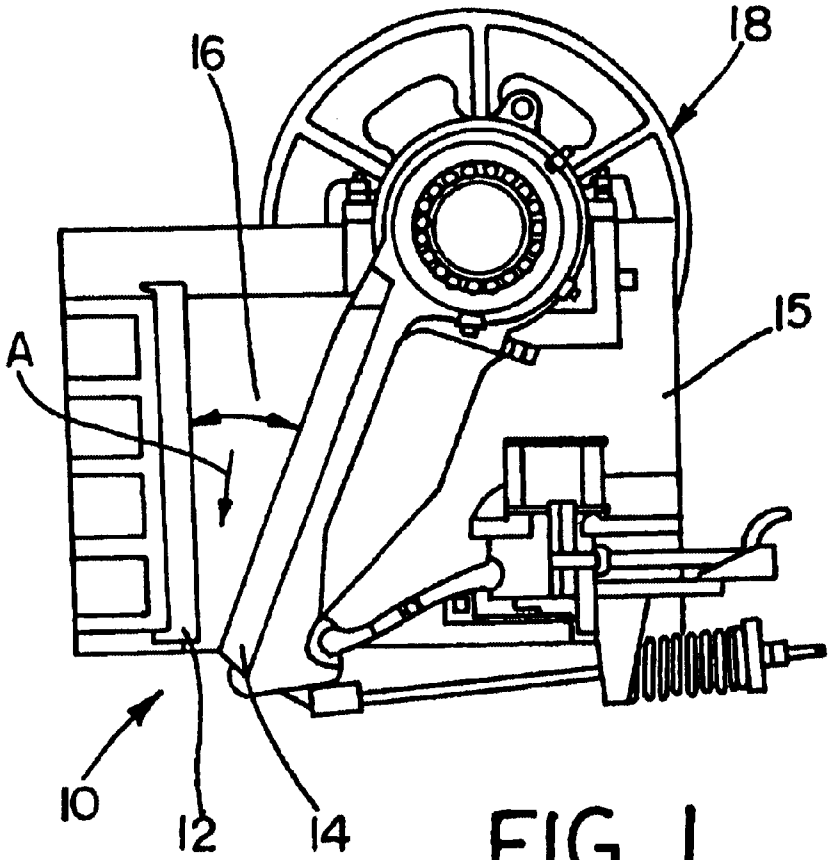
FIG. 1 PRIOR ART
FIG. 1 is a fragmentary cross-sectional view of a typical jaw crusher having a portion of the sidewall cut away and having a stationary jaw, a moveable jaw, a crushing chamber defined between the stationary jaw and the moveable jaw.

Referring now to the drawings, FIG. 1 illustrates a jaw crusher 10 of the type generally well known in the art. The jaw crusher 10 includes a stationary jaw 12 and a moveable jaw 14, which are mounted to a frame 15 and which are spaced apart to define a crushing chamber 16 between the stationary jaw 12 and the moveable jaw 14. The jaw crusher 10 also includes a drive system 18 of the type generally well known in the art and which is adapted to reciprocate the moveable jaw 14 back and forth relative to the stationary jaw 12 so as to crush aggregate material fed into the crushing chamber 16 by a conventional feed system generally along a material flow path A. As shown in FIG. 2, aggregate material 20 disposed in the crushing chamber 16 will be crushed by opposing sets of teeth 22, 24 on the stationary jaw 12 and the moveable jaw 14, respectively, due to the repetitive back and forth movement of the moveable jaw 14 relative to the stationary jaw 12. The jaw crusher 10 will also includes a variety of other system components (not shown), all of which are known to those skilled in the art.

Figure 3:
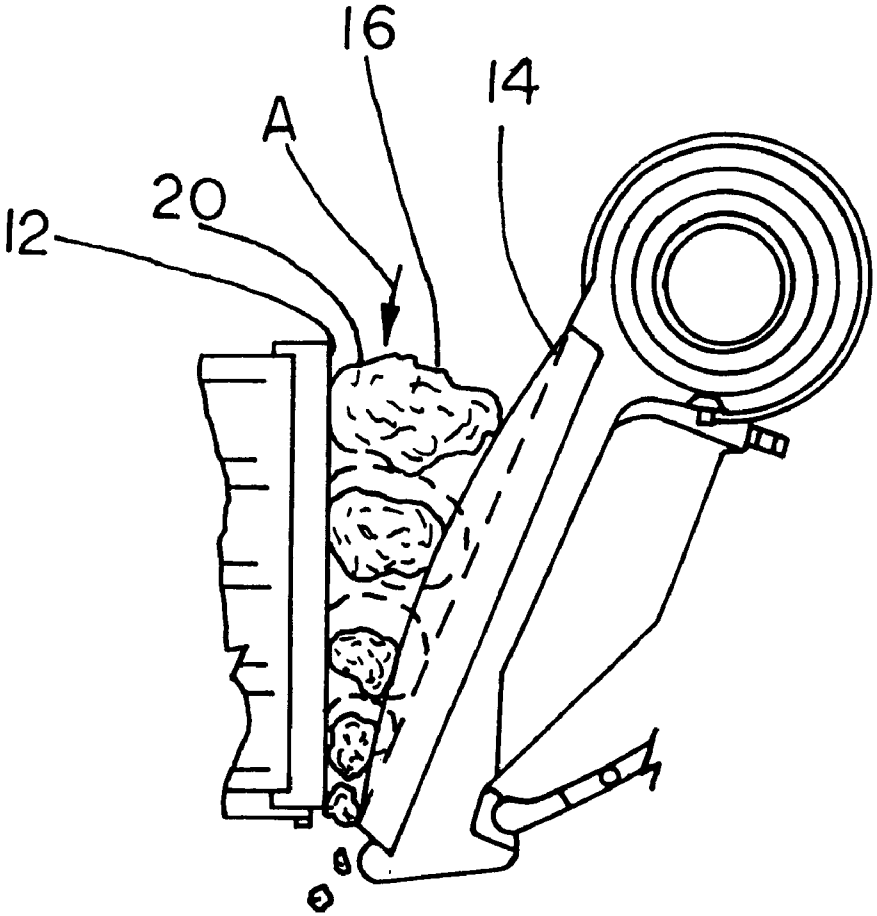
FIG. 3 is an enlarged fragmentary cross-sectional view comparing the location of various aggregate sizes in the crushing chamber when using an arc-shaped or bellied jaw profile (solid lines) and a straight jaw profile (dotted lines)
Figure 4:
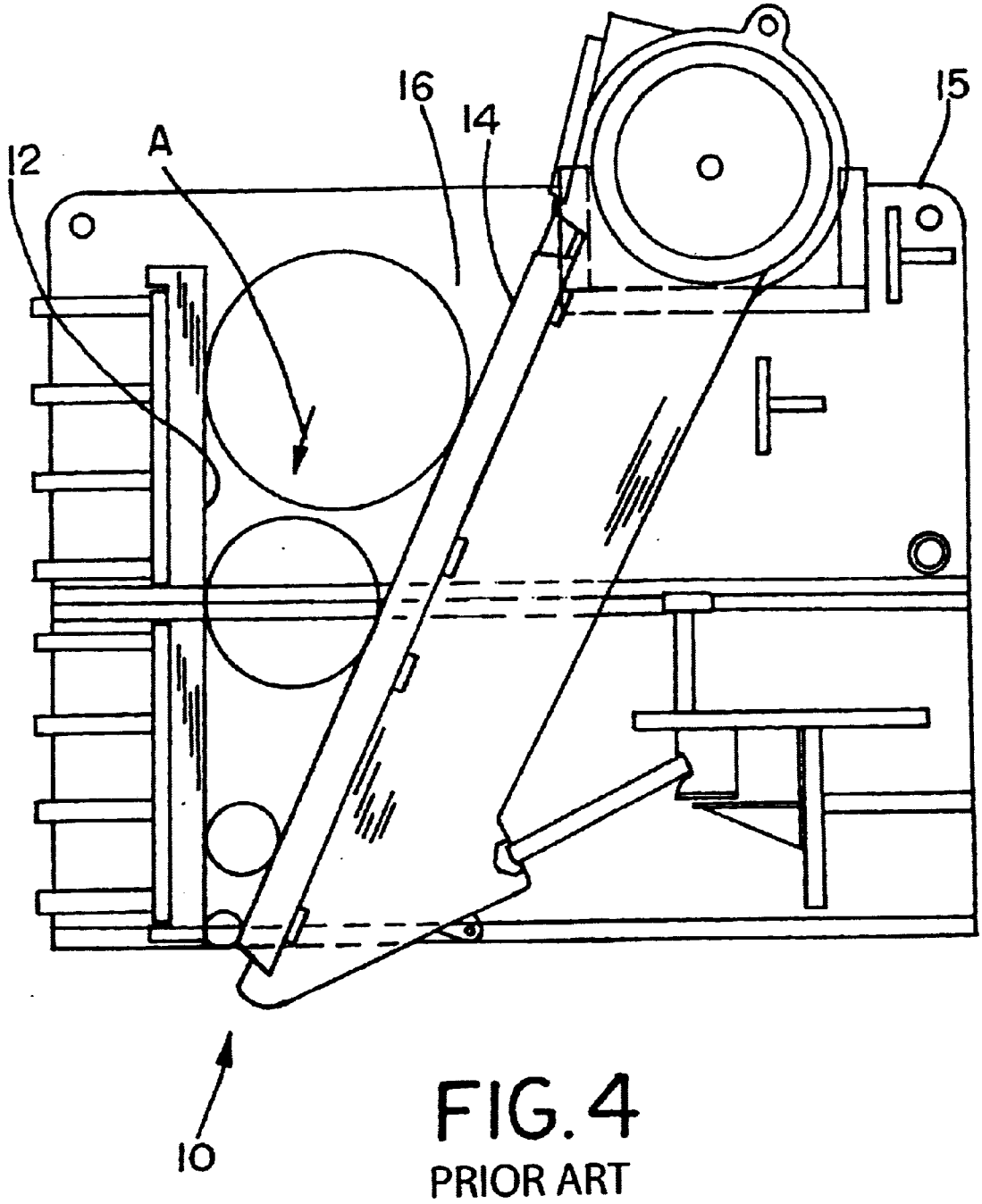
FIG. 4 PRIOR ART
FIG. 4 is an enlarged fragmentary cross-sectional view showing aggregate locations within a jaw crusher having a straight profile for both the stationary jaw and the moveable jaw.
Figure 5:
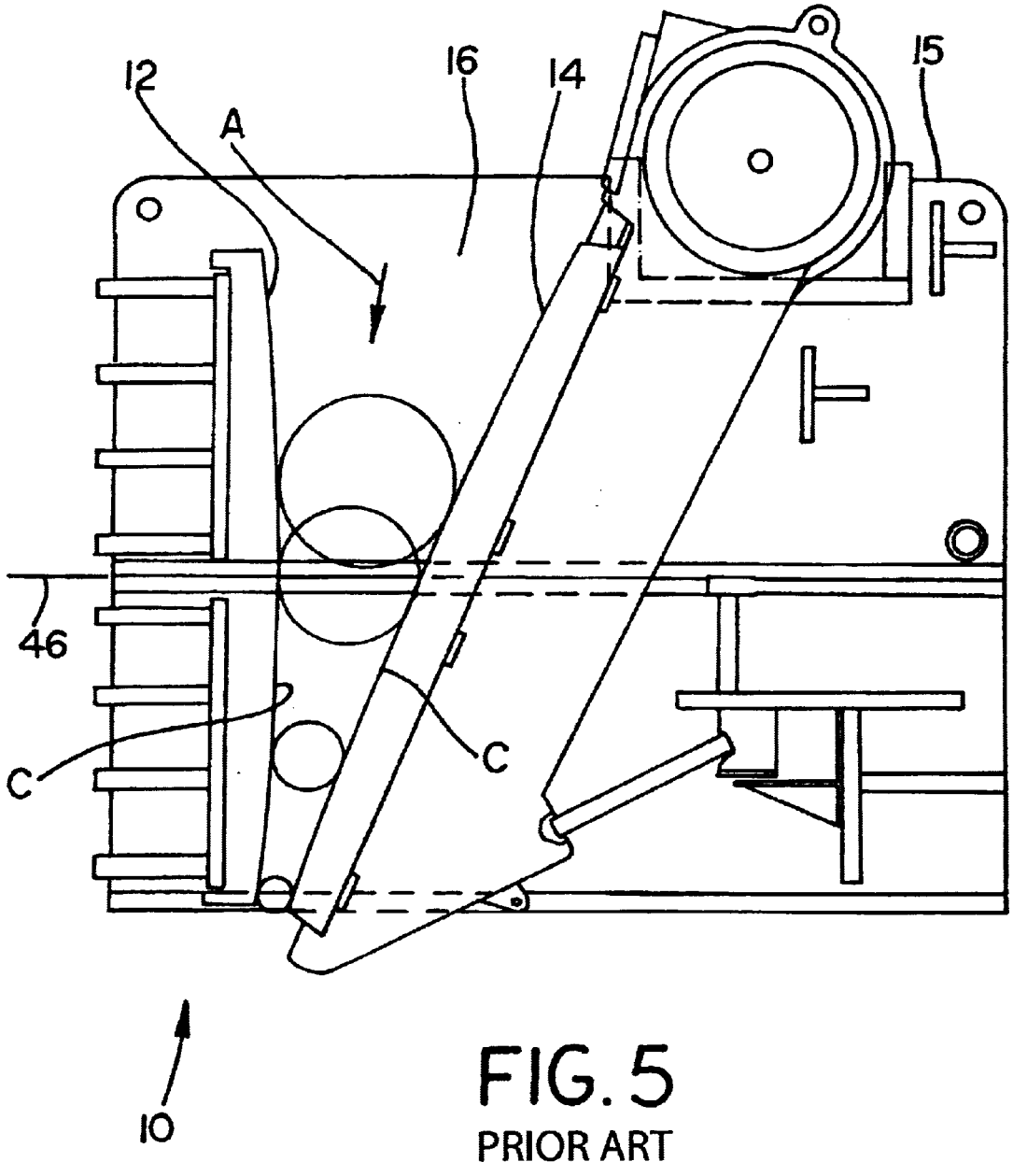
FIG. 5 PRIOR ART
FIG. 5 is an enlarged fragmentary cross-sectional view similar to FIG. 4 and showing aggregate locations within the same jaw crusher, but having an arc-shaped profile for both the stationary jaw and the moveable jaw.

FIG. 3 illustrates various sizes of aggregate material 20 disposed at various heights within the crushing chamber of a conventional jaw crusher employing a straight jaw profile (dotted lines in FIG. 3) as opposed to a circular arc bellied profile (solid lines in FIG. 3). Similarly, FIGS. 4 and 5 compare the vertical location of various aggregate sizes within the crushing chamber of the same size conventional jaw crusher having a straight jaw profile (FIG. 4) and a circular arc bellied profile (FIG. 5). These examples are included so that the reader may understand the references to jaw profiles in general and to vertical location of aggregate material within the crushing chamber.

Figure 6:
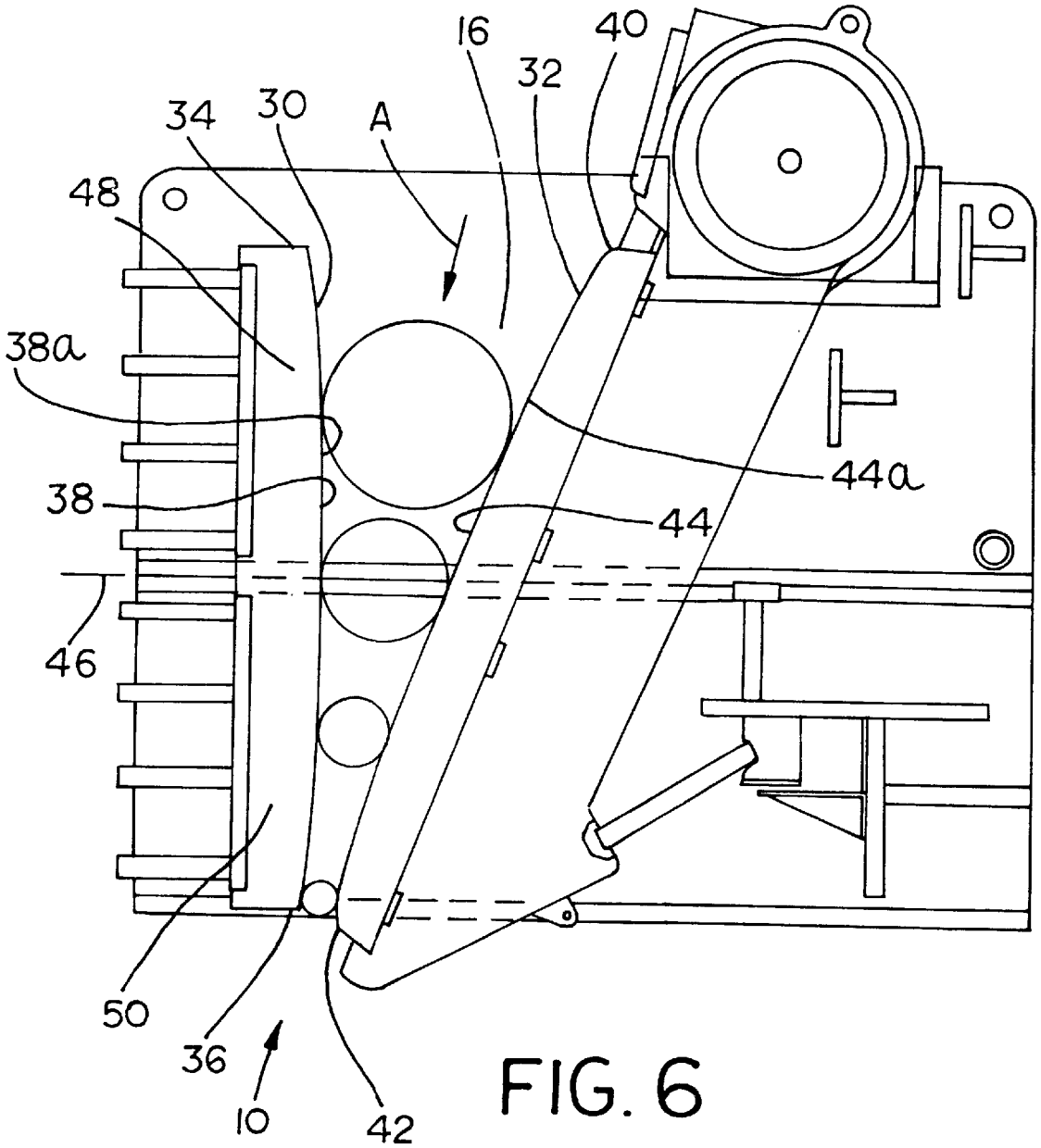
FIG. 6 is an enlarged fragmentary cross-sectional view of a jaw crusher having a stationary jaw and a moveable jaw, and in which at least one of the jaws is constructed in accordance with the teachings of a preferred embodiment of the present invention to have an elliptical profile.

Referring now to FIG. 6, the jaw crusher 10 includes a stationary jaw 30 and a moveable jaw 32 constructed in accordance with the teachings of the present invention. The stationary jaw 30 includes a top edge 34, a bottom edge 36, and an interconnecting face 38 following an elliptical profile 38*a*. The moveable jaw 32 also a top edge 40, a bottom edge 42, and an interconnecting face 44 following an elliptical profile 44*a*. The stationary jaw 30 may be symmetrical about a horizontal centerline 46 so as to include an upper die 48 and a lower die 50. The upper die 48 and the lower die 50 may thus be interchanged with each other. The stationary jaw 30, including the upper die 48 and the lower die 50, and the moveable jaw 32 will include one or more conventional mounting lugs (not shown) which permit the jaws 30 and 32 to be mounted to the frame 15 of the jaw crusher 10 in a well known manner.

Figure 7:
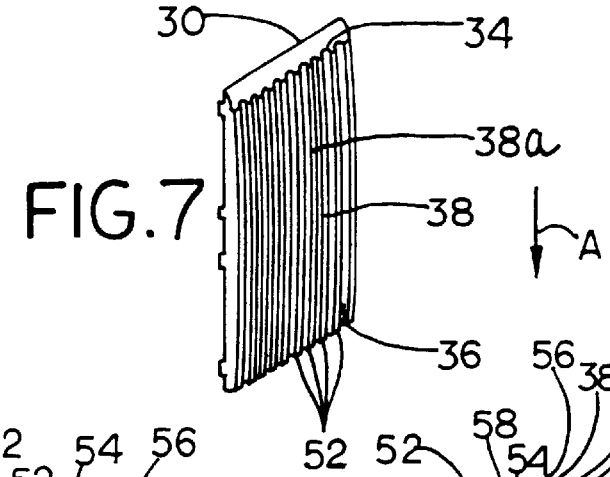
FIG. 7 is a perspective view of an exemplary elliptical jaw constructed in accordance with the teachings of the present invention.
Figure 9:
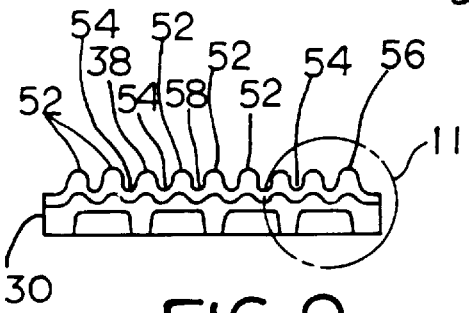
FIG. 9 is top plan view thereof.
Figure 11:
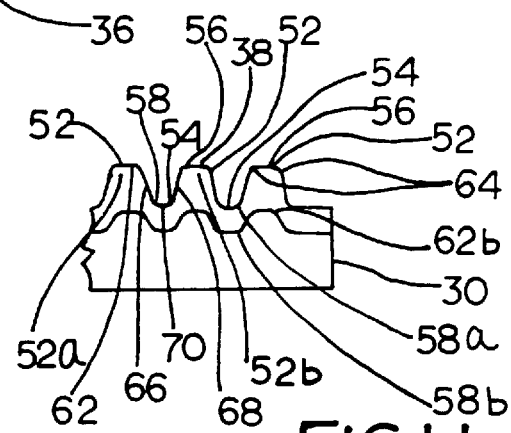
FIG. 11 is an enlarged fragmentary top plan view taken about the circumscribed portion of FIG. 9.
Figure 10:
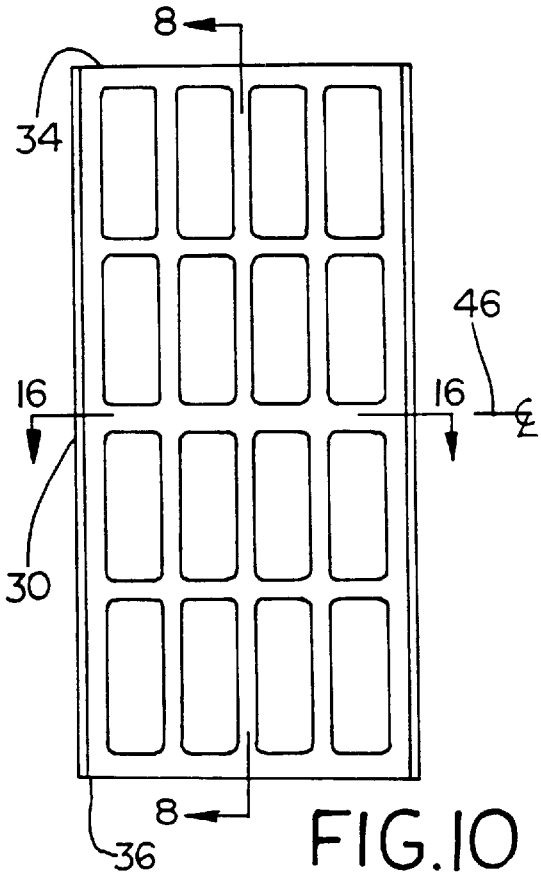
FIG. 10 is a rear elevational view thereof.
Figure 8:
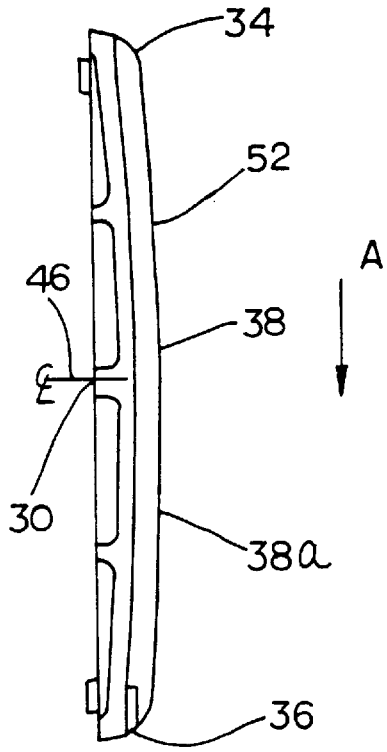
FIG. 8 is a cross-sectional view taken along line 8—8 of FIG. 10.

Referring now to FIGS. 7–11, the stationary jaw 30 is shown therein. It will be understood that the moveable jaw 32, in the event both of the jaws 30 and 32 are elliptical, will be substantially similar to the stationary jaw 30. Thus, in the interest of brevity only the stationary jaw 30 need be described in detail. As shown in FIGS. 7, 9 and 11, the face 38 of the stationary jaw 30 includes a plurality of teeth 52, with each of the teeth 52 being separated from its adjacent teeth by a valley 54. The teeth 52 are oriented generally parallel to the flow path A. As shown in FIGS. 9 and 11, each tooth 52 includes a peak 56, while each valley 54 includes a floor 58. It will be noted that the peak 56 of each of the teeth 52 are generally coincident with the elliptical profile 38*a* along the face 38 between the top edge 34 and the bottom edge 36 (FIGS. 7 and 8). As outlined above, the stationary jaw 30 may be divided into an upper die 48 and a lower die 50, in which case the upper and lower dies 48, 50 are individually mountable to the frame 15 of the jaw crusher 10. It will also be noted that the moveable jaw 32 is typically constructed as a single unit rather than being divided into upper and lower dies. However, such a divided moveable jaw would nevertheless fall within the scope of the claims appended hereto.

Figure 12:
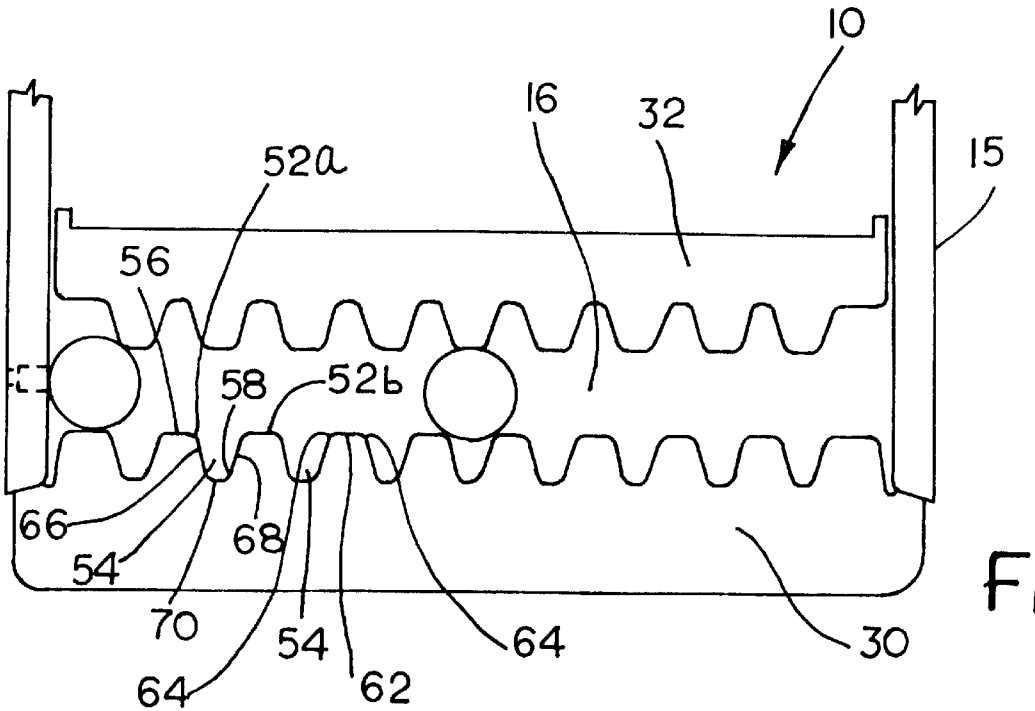
FIG. 12 is a fragmentary top plan view illustrating a flattened tooth profile on each of the stationary and moveable jaws.

Referring now to FIGS. 11 and 12, the peak 56 of each of the teeth 52 may have a flat profile 62 when viewed in cross-section from above. The flat profile 62 may include generally rounded corners 64. The valley 54 between adjacent teeth, for example between the tooth 52*a* and the tooth 52*b*, includes a pair of sidewalls 66, 68. The sidewalls 66, 68 each include a lower end 70, which meet at the floor 58. Preferably, the floor 58 is arc-shaped having a radius of 1.5 inches. As shown in FIG. 11, the teeth 52 may have a first peak profile 62*a* and first floor shape 58*a* toward the horizontal centerline 46 of the jaw 30, and a second profile 62*b* and a second floor shape 58*b* toward the top edge 34 and the bottom edge 36 of the jaw 30.

Figure 16:
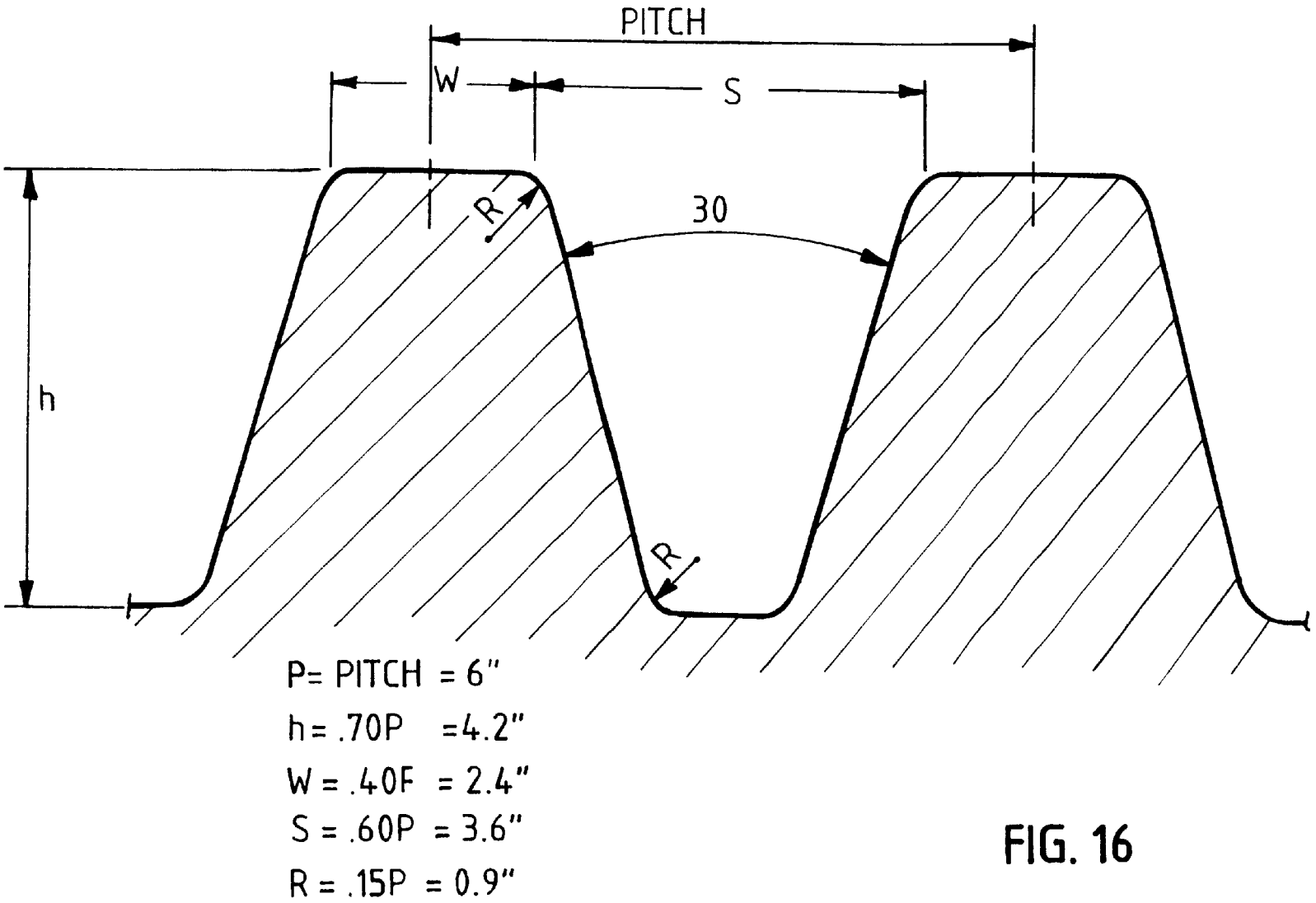
FIG. 16 is an enlarged fragmentary cross-sectional view taken along line 16—16 of FIG. 10.

Referring now to FIG. 16, further details of the first peak profile 62*a* are shown therein in accordance with a preferred embodiment. The profile 62*a* at or near the centerline 46 includes a pitch P, a height H, a width W, a radius R, and a spacing S. One a preferred pitch P is established, the remaining dimensions may be sized proportional to the pitch dimensions. For example, when applied to a Cedarapids Model 5460 Jaw Crusher, manufactured by Cedarapids, Inc., having pitch P of six inches (6"), the remaining dimensions may be:

H=0.7P=4.2"

W=0.4P=2.4"

R=0.15P=0.9"

S=0.6P=3.6"

These dimensions may be modified as necessary near the outside edges of the jaws. Further, a portion of the valleys 54 adjacent the top and bottom ends may be filled or partially filled, which compensates for increased wear at the ends. The filled or partially filled valleys 54 adjacent the top and bottom ends effectively make the valleys 54 less deep adjacent the top and bottom ends (e.g., the value for H is less). The additional material may also effectively lengthen the useful life of the jaws. Making the ends the same assures symmetry when the jaws are turned end-for-end in the life cycle. The end fill may have a larger radii which varies in a smooth, stepless transition to match the 30 degree angle between the sidewalls 66, 68, at the centerline 46. Finally, the width W may be constant along the entire length of the tooth.

Figure 15:
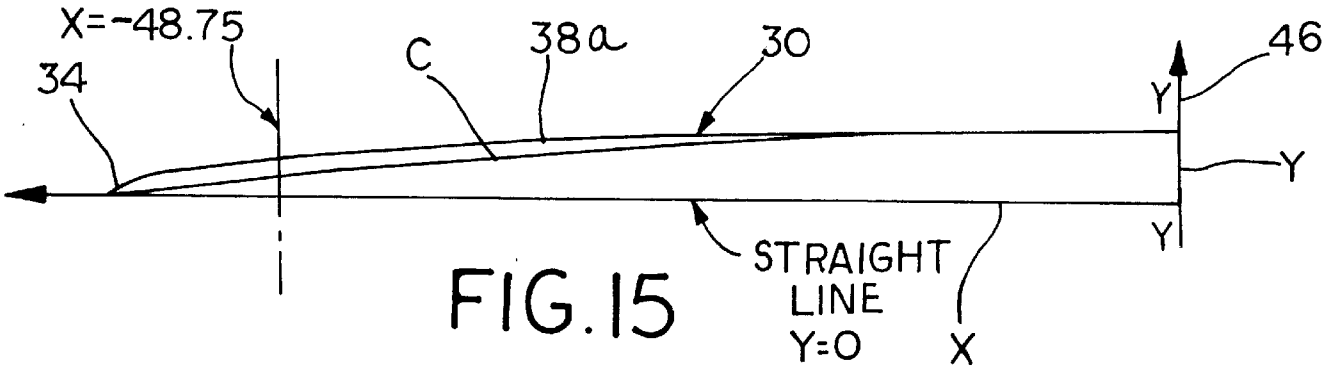
FIG. 15 is a graphical representation of one possible function for constructing the elliptical profile of at least one of the jaws.

Referring now to FIG. 15, one possible elliptical function for the jaw profile is shown. The elliptical profile 38*a* shown therein is intended to be exemplary of the disclosed embodiment. The exemplary profile is not intended to limit the scope of the invention to the function or dimensions shown or discussed herein. In FIG. 15, the Y axis corresponds to the horizontal centerline 46 of the jaw, for example either the jaw 30 or the jaw 32. In the example shown, the Y dimension corresponds to the distance from the X axis, while the X dimension corresponds to the distance from the centerline 46. Only half of the resulting graph is shown, it being understood that the other half of the elliptical function would be symmetrical about the centerline 46. A conventional circular arc-shaped profile C is shown for comparison purposes.

As shown for comparison purposes in FIG. 15, the slope of the X axis (a straight line) is dy/dx=0. The slope of the exemplary arc-shaped profile C is dy/dx=−x/y. The slope of the elliptical profile is dy/dx=−x/225y. For the exemplary jaw size shown in the FIG. 15, the length of the jaw (e.g., the height when oriented vertically on a crusher) is 112.5 inches, which roughly corresponds to the jaw height of a Cedarapids Model 5460 Jaw Crusher, manufactured by Cedarapids, Inc., the assignee of the present application. The arc-shaped profile C shown has a radius of 423.75 inches. Both the elliptical profile and the arc-shaped profile shown have Y value at the centerline 46 of about 3.75 inches. Thus, for the size shown, the slope of the elliptical profile 38*a* and the slope of the arc-shaped profile C will be the same at the centerline 46, and at X=−48.75 inches (e.g., 7.5 inches from the edge shown to the left of FIG. 15). Thus, it is evident that the rate of change of the slope for the elliptical profile 38*a* is different than the rate of change of the arc-shaped profile C.

It will be understood that the nip angle N, which can be calculated using methods known to those of skill in the art, varies with distance from the centerline 46, both above and below the centerline 46. For example, referring to FIGS. 13 and 14, the nip angle N will have a relatively low value $N_1$ toward the lower portions of the crushing chamber 16, a relatively larger value $N_2$ toward the middle portion of the crushing chamber 16, and a larger still value $N_3$ toward the upper portion of the crushing chamber 16. For both a circular-arc shaped jaw and an elliptical jaw, the nip angle N will vary as the profile of the jaw varies. Further, as shown in FIG. 15, because the elliptical profile 38*a* is different than the circular arc-shaped profile C of the conventional bellied jaw, the elliptical profile 38*a* will result in a nip angle N that varies with distance from the centerline 46 in a fashion that is distinct from the circular-arc shaped jaw profile C.

Figure 13:
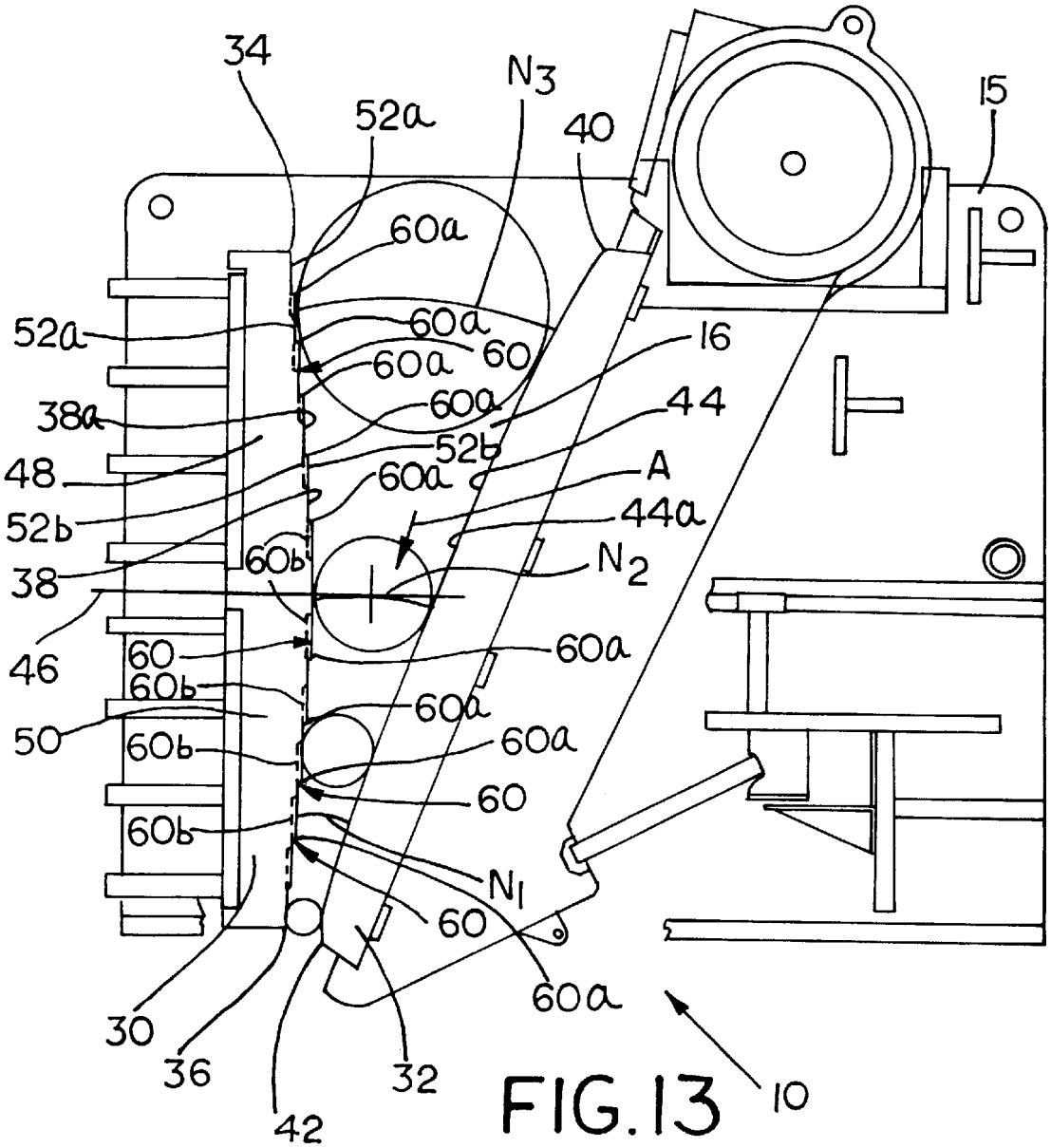
FIG. 13 is an enlarged fragmentary cross-sectional view of a jaw crusher having a stationary jaw and a moveable jaw, and in which at least one of the jaws is constructed in accordance with the teachings of the present invention to have an elliptical and stepped jaw profile.
Figure 14:
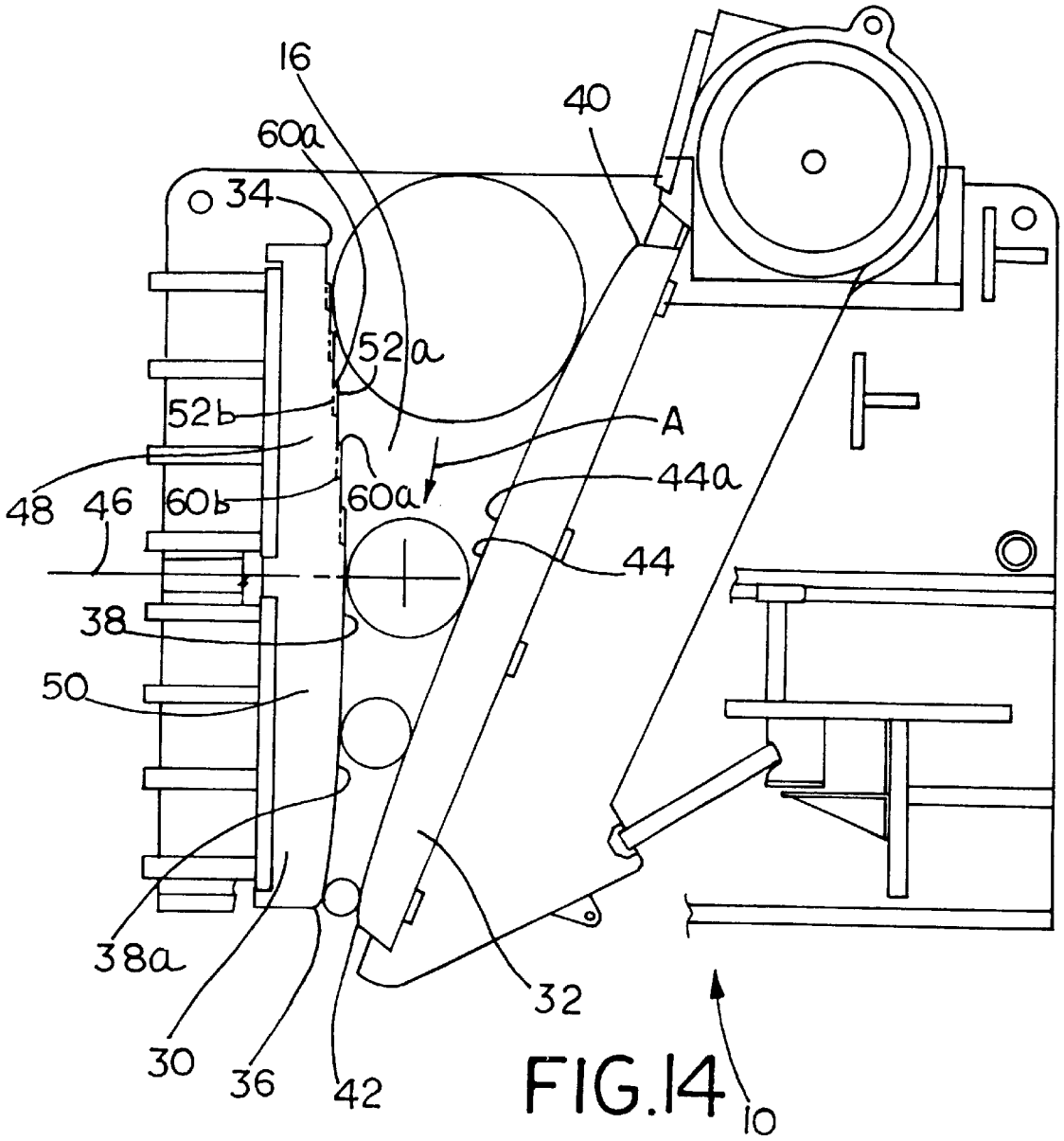
FIG. 14 is an enlarged fragmentary cross-sectional view of a jaw crusher having a stationary jaw and a moveable jaw, and in which at least one of the jaws is constructed in accordance with the teachings of the present invention to have an overall elliptical profile and a stepped upper portion.

Referring now to FIGS. 13 and 14, at least some of the teeth 52 may include a plurality of steps 60. In the embodiment of FIG. 13, the steps 60 on the upper die 48 face generally upwardly, while the steps 60 on the lower die 50 face generally downwardly. A one piece jaw 32 may also be formed such that the teeth 52 on an upper portion of the jaw are stepped and the teeth on the lower portion of the jaw are smooth, or vice versa. Further, a set of steps 60*a* on one of the teeth, e.g., a tooth 52*a* shown in solid lines in FIG. 13, may of vertically located as shown, while a second set of steps 60*b* on an adjacent tooth 52*b,* shown in dotted lines in FIG. 13 and located next to the tooth 52*a,* will have a set of steps 60*b* located at a different vertical location relative to the steps 60*a,* such that the steps 60*a* and 60*b* are vertically staggered relative to each other. The steps 60*a* and 60 will preferably both follow the elliptical profile 38*a,* with the profile between the steps 60*a,* 60*b* deviating only slightly from the elliptical profile 38*a*. As outlined above, the moveable jaw 32 may have a similar stepped profile. As shown in FIG. 14, the upper die 48 may have a profile 38*a* including teeth 52*a,* 52*b* having vertically staggered stepped teeth 60*a,* 60*b,* while the lower die 50 includes only the elliptical profile 38*a* without the steps 60. The above-described features be switched, such that the upper die 48 includes the teeth 52, while the lower die 50 includes the vertically staggered stepped teeth 52*a,* 52*b*.

In operation, the jaw crusher 10 is operated according to conventional practices in a manner well known in the art. Further, during the course of operation of the jaw crusher 10, the wear patterns on the faces 38, 44 wear in a manner determined at least in part by the nip angle N. The jaws 30, 32 having the elliptical profiles 38*a,* 44*a* constructed according to the disclosed embodiment of the present invention will cause aggregate material to proceed slower along the path A through the crushing chamber 16 for a given material size as compared to conventional circular arc-shaped bellied jaws. This causes the material to remain on the contact surfaces longer resulting in more even wear patterns relative to more conventional jaw profiles. Further, the jaws according to the disclosed embodiments including steps will more readily accept and retain larger aggregate sizes as compared to conventional circular arc-shaped bellied jaws.

The steps 60 may be sized in a manner proportional to the stroke of the jaw crusher. In the event the steps are vertically staggered as described above, the vertical staggering can be arranged such that the material is generally directed toward the center (relative to a vertical centerline) of the crushing chamber 16. For example, if the step 60*a* is slightly higher than the step 60*b*, and the step 60*b* is located nearer the center (relative to the vertical centerline) of the crushing chamber than the step 60*a,* then the material will fall downward and inward as the material proceeds through the crushing chamber 16.

Further, referring again to FIG. 13, the distance that each step 60*a* protrudes outwardly relative to its immediate adjacent steps (e.g., in a generally horizontal direction position when the jaw is in use) is preferably kept smaller than the horizontal movement of the moveable jaw. This helps to ensure that the material that is gripped on the closed stroke of the crusher will be released on the open stroke of the crusher. If the steps are too high (e.g., if the horizontal distance that each step protrudes outwardly from its adjacent step is too large), then rock material may become stuck at the step and may clog the crusher or may impede the flow of material through the crusher.

When constructed in accordance with the disclosed embodiment, the jaws 30, 32 may offer improved grip of the aggregate material, improved crushing performance, and/or improved jaw service life. The improved grip may permit the jaws to be reduced in size and height, thus permitting manufacture of a smaller, more compact crushing device at a lower cost, and further resulting in a crushing device that is easier to assemble, transport, and/or service. The slope of a jaw employing an elliptical profile will have a slower rate of change as one proceed with distance away from the centerline of the jaw (both upwardly and downwardly from the centerline) as compared to a more conventional circular or "bellied" jaw profile. The more gradual, elliptical curve may thus hold or grip the aggregate material longer as the material proceed along the flow path, which may help to even out the wear on the contact surfaces of the jaw(s). Moreover, a crushing device employing the jaws in accordance with the disclosed embodiment may accommodate a wider range of material types, sizes, and/or shapes, while lessening the chances of material rejection due to unfavorable nip angles. The tooth profile according to the disclosed embodiment may also serve to prevent material clogging in the valleys between the teeth.

Quantitative Example

As shown in FIG. 4, a jaw crusher having straight or linear jaw profiles will have a linear rate of change of the size of the crushing chamber. The maximum material feed size is about forty three (43) inches in diameter (80% of the feed opening, or 0.8*54 inches {Model 5460}=43.2 inches). The opening halfway down the chamber is about twenty eight

(28) inches, and a twelve (12) inch diameter aggregate is crushed about seventeen (17) inches from the bottom of the crushing chamber. All of the above dimensions are rounded to the nearest inch, and again refer to a Cedarapids Model 5460 Crusher, having a six (6) inch closed side setting (CSS).

As shown in FIG. 5 in which the Model 5460 Crusher is equipped with a circular arc-shaped bellied jaw having an arc radius of 423.75 inches, the maximum feed size for the crusher shown is about thirty three inches diameter, which is less than that shown in FIG. 4 with respect to straight or linear jaws. The opening half way down the chamber is about twenty one (21) inches, again less than that shown in FIG. 4. A twelve inch diameter aggregate will be crushed about twenty five (25) inches from the bottom of the crushing chamber, again with a six (6) inch CSS. The curve (i.e., the deviation from a straight profile at the centerline of the jaw) is about 3.25 inches on the stationary jaw and about two (2) inches on the moveable jaw, for a total curve of 5.25 inches. The bellied jaw shown will have a more desireable rate of change for the nip angle (as compared to the linear jaw of FIG. 4, which has a rate of change for the nip angle of zero).

As shown in FIGS. 6, 13, and 14 the elliptical jaws or jaws with elliptical contact surfaces have an even slower rate of change as compared to a circular arc-shaped jaw. The elliptical jaws, even with more total curvature as compared to a circular arc-shaped jaw, can crush larger material at a 25 degree nip angle than the circular arc-shaped jaws. The feed size is about thirty three (33) inches at a twenty five (25) degree nip angle, with the opening halfway down the chamber measuring about twenty one (21) inches, and with twelve (12) inch material being crushed about thirty (30) inches from the bottom of the crushing chamber. The amount of "belly" on these jaws is 4¼" on the movable jaw, and 3¾" on the stationary jaw, for a total curve of about 8". This equates to 8.0/54=14.8%. The maximum feed size is larger than a circular arc-shaped jaw. The feed material in the crushing chamber will progress slower downwardly through the crushing chamber, and will remain on the contact surfaces longer. This spreads the wear across these surfaces.

In order to further increase the allowable maximum feed size beyond the capability of elliptical curve jaws, the crushing surfaces may, as an alternative, also be stepped. These steps, in the disclosed embodiment, are preferably parallel to the back of the jaw. Also, the steps may generally follow the elliptical profile. In the jaw crusher, the steps may help to guide the material in horizontal increments. The steps may be sized proportional to the stroke of the crusher, and may further urge feed material to move inward as the material moves downward in the crushing chamber. The steps, located as described on the vertical stationary jaw, do not affect the nip angle. The feed material is crushed against the flat surfaces or plateaus between steps. In order to prevent feed material from gathering at the edge of the crushing chamber and retarding the flow of material through the crushing chamber, the steps on adjacent teeth may be vertically staggered relative to each other. If the feed material contacts the step on one tooth, a plateau will be contacted on the adjacent teeth on either side. Thus the ability to grip the material is maintained or enhanced. The steps may be symmetric about the height of the jaw (in a vertical position). The jaw thus retains the ability to be reversed in order to achieve maximum wear life.

As shown in the example of FIG. 13, the maximum feed material is about forty three (43) inches at about a 25 degree nip angle. The opening halfway down the chamber is about twenty (20) inches. A twelve (12) inch piece of aggregate material is crushed about thirty (30) inches from the bottom of the crushing chamber at a 6 inch CSS. This configuration retains the advantage of the elliptical curve jaws, but with a increase in maximum feed capability. See FIG. 13.

A number of combinations are possible. The jaw crusher shown in FIG. 14, again, a model 5460, has a two-piece stationary jaws. As shown in FIG. 14, the movable jaw is elliptical, the lower stationary jaw is elliptical, and the upper stationary jaw is elliptical with stepped teeth. This alternate example retains the maximum feed capability of the straight jaws, but with more favorable jaw contact and wear characteristics.

Finally, gradation (which is typically expressed as a percentage of crushed material passing through a standardized screen size) may be favorably affected by an elliptical jaw according to one or more of the disclosed embodiments.

The elliptical jaws, due increased contact of the material on the crushing surfaces, may exhibit a finer gradation, and/or a more thoroughly crushed output product. This may be due to the feed material experiencing more crushing cycles. This finer output material is more predictably crushed without plugging by secondary or tertiary crushes in the overall crushing system.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed:

1. A jaw crusher, comprising:

a frame;

a stationary jaw, the stationary jaw mounted to the frame and having a top edge, a bottom edge, and an interconnecting face extending between the top edge and the bottom edge; and a moveable jaw, the moveable jaw shiftably mounted to the frame and being moveable toward and away from the stationary jaw, the moveable jaw having a top edge, a bottom edge, and an interconnecting face extending between the top edge and the bottom edge;

wherein the face of at least one of the stationary jaw and the moveable jaw includes a curved profile; and wherein the curved profile is elliptical.

2. The jaw crusher of claim 1, wherein the face of the at least one jaw includes a plurality of teeth extending between the top edge and the bottom edge, each of the teeth including a peak and being spaced from its adjacent teeth by a valley.

3. The jaw crusher of claim 2, wherein the peak of each of the teeth is generally coincident with the elliptical profile.

4. The jaw member of claim 2, wherein at least some of the teeth include a plurality of steps, the steps spaced at intervals along the face of the jaw member.

5. The jaw crusher of claim 4, wherein the steps of one of the teeth are vertically staggered relative to the steps of an adjacent one of the teeth.

6. The jaw member of claim 2, wherein the peak is flattened.

7. The jaw member of claim 2, wherein each of the valleys includes a pair of side walls, each of the sidewalls having a lower end that terminates at a curved floor, the curved floor having a radius greater than half the distance between the lower ends.

8. The jaw crusher of claim 1, wherein the face of both of the jaws follow an elliptical profile.

9. The jaw crusher of claim 1, wherein the face of the at least one jaw includes an upper portion, a lower portion, and a plurality of teeth, the teeth oriented generally parallel to a material flow path though the jaw crusher, each of the teeth including a peak and being spaced from its adjacent teeth by a valley, and wherein the teeth on at least one of the upper portion and the lower portion includes a plurality of spaced steps.

10. The jaw crusher of claim 9, wherein the steps of one of the teeth are vertically staggered relative to the steps of an adjacent one of the teeth.

11. A jaw member for mounting to the frame of a jaw crusher, the jaw comprising:

a rear surface adapted for mounting to the frame;

a top edge;

a bottom edge; and an interconnecting face extending between the top edge and the bottom edge;

wherein the face of the jaw member includes a curved profile; and wherein the curved profile is elliptical.

12. The jaw member of claim 11, wherein the face includes a plurality of teeth extending between the top edge and the bottom edge, each of the teeth including a peak and being spaced from its adjacent teeth by a valley.

13. The jaw member of claim 12, the peak of each of the teeth being generally coincident with the elliptical profile.

14. The jaw member of claim 12, wherein at least some of the teeth include a plurality of steps, the steps spaced at intervals along the face of the jaw member.

15. The jaw crusher of claim 14, wherein the steps of one of the teeth are vertically staggered relative to the steps of an adjacent one of the teeth.

16. The jaw member of claim 12, wherein each of the teeth includes a flattened peak.

17. The jaw member of claim 16, wherein each of the valleys includes a pair of side walls, each of the sidewalls having a lower end that terminates at a curved floor, the curved floor having a radius greater than half the distance between the lower ends.

18. A jaw member for mounting to the frame of a jaw crusher, the jaw comprising:

mounting means for mounting the jaw member to the frame;

a top edge;

a bottom edge; and an interconnecting face extending between the top edge and the bottom edge;

a plurality of teeth formed on the face and extending between the top edge and the bottom edge, each of the teeth including a peak, the peak of each of the teeth spaced from any adjacent teeth by a valley;

wherein the peak of each of the teeth generally corresponds to a curved profile; and wherein the curved profile is elliptical.

19. The jaw member of claim 18, wherein at least some of the teeth include a plurality of vertically spaced steps.

20. The jaw member of claim 19, wherein the steps each if the teeth are vertically staggered relative to the steps of its adjacent teeth.

21. The jaw member of claim 19, wherein the peak of each of the teeth is flattened.

22. The jaw member of claim 18, wherein each of the valleys includes a pair of side walls, each of the sidewalls having a lower end that terminates at a curved floor, the curved floor having a radius greater than half the distance between the lower ends.

23. A jaw crusher, comprising:

a frame;

a stationary jaw, the stationary jaw mounted to the frame and having a top edge, a bottom edge, and an interconnecting face extending between the top edge and the bottom edge; and a moveable jaw, the moveable jaw shiftably mounted to the frame and being moveable toward and away from the stationary jaw, the moveable jaw having a top edge, a bottom edge, and an interconnecting face extending between the top edge and the bottom edge;

wherein the face of at least one of the stationary jaw and the moveable jaw includes a plurality of spaced apart teeth, each of the teeth having a peak following a curved profile; and wherein the curved profile is elliptical.

24. The jaw crusher of claim 23, wherein the teeth include a plurality of vertically spaced steps.

25. The jaw crusher of claim 24, wherein the steps of one of the teeth are vertically staggered relative to the steps of an adjacent one of the teeth.

26. The jaw crusher of claim 23, wherein the peak is generally flattened.

27. The jaw crusher of claim 23, wherein each of the teeth is separated from adjacent teeth by a valley, and wherein the valley includes an arc-shaped floor.

28. A jaw crusher comprising:

a frame;

a stationary jaw, the stationary jaw mounted to the frame and having a top edge, a bottom edge, and an interconnecting face extending between the top edge and the bottom edge; and a moveable jaw, the moveable jaw mounted to the frame so as to be moveable toward and away from the stationary jaw, the moveable jaw having a top edge, a bottom edge, and an interconnecting face extending between the top edge and the bottom edge;

a crushing chamber defined between the stationary jaw and the moveable jaw, the crushing chamber having a lower portion, an upper portion;

a nip angle defined between the stationary jaw and the moveable jaw; and means defined by the surface of at least one of the stationary jaw and the moveable jaw for varying the nip angle between a first nip angle toward the lower portion of the crushing chamber and a second nip angle toward the upper portion of the crushing chamber, the second nip angle greater than the first nip angle, the means varying the nip angle according to a curved profile;

wherein the curved profile is elliptical.

29. The jaw crusher of claim 28, wherein the face of the at least one jaw includes a plurality of spaced apart teeth, each of the teeth having a peak generally following the nip angle.

30. The jaw crusher of claim 29, wherein the teeth include a plurality of steps.

31. The jaw crusher of claim 30, wherein the steps of one of the teeth are vertically staggered relative to the steps of an adjacent one of the teeth.

32. A jaw crusher, comprising:

a frame;

a stationary jaw, the stationary jaw mounted to the frame and having a top edge, a bottom edge, and an interconnecting face extending between the top edge and the bottom edge; and a moveable jaw, the moveable jaw shiftably mounted to the frame and being moveable toward and away from the stationary jaw, the moveable jaw having a top edge, a bottom edge, and an interconnecting face extending between the top edge and the bottom edge;

wherein the face of at least one of the stationary jaw and the moveable jaw includes a curved profile defined by $AX^2+BY^2=C$;

wherein (X,Y) is a coordinate of a point on the face such that X is a distance from the face to a vertical axis of the jaw, and Y is a distance from the face to a horizontal axis of the jaw, and wherein A and B are constants having values not equal to zero and not equal to each other, and C is a constant having a value not equal to zero.

* * * * *

UNITED STATES PATENT AND TRADEMARK OFFICE

CERTIFICATE OF CORRECTION

PATENT NO. : 6,641,068 B2
DATED : November 4, 2003
INVENTOR(S) : David Ostergaard It is certified that error appears in the above-identified patent and that said Letters Patent is hereby corrected as shown below:

Column 9,
Lines 65 and 66, pleaes delete “the steps each if the teeth” and insert instead
-- the steps of each of the teeth --.

Signed and Sealed this

Twentieth Day of April, 2004

JON W. DUDAS
*Acting Director of the United States Patent and Trademark Office*